United States Patent [19]

Korper

[11] Patent Number: 4,594,014

[45] Date of Patent: Jun. 10, 1986

[54] FOUNTAIN BRUSH

[75] Inventor: George W. Korper, Dickerson, Md.

[73] Assignee: Wite-Out Products, Inc., Beltsville, Md.

[21] Appl. No.: 732,597

[22] Filed: May 10, 1985

[51] Int. Cl.[4] ..... A46B 11/00

[52] U.S. Cl. ..... 401/115; 401/101; 401/269; 401/274

[58] Field of Search ..... 401/101, 115, 274, 183, 401/269

[56] References Cited

U.S. PATENT DOCUMENTS

| | | | |
|---|---|---|---|
| 2,908,926 | 10/1959 | Jockers | 401/115 |
| 2,932,046 | 4/1960 | Skolnikoff | 401/115 |
| 3,144,676 | 8/1964 | Lamura | 401/115 X |
| 3,420,611 | 1/1969 | Towns | 401/115 |
| 4,063,829 | 12/1977 | Lamura | 401/115 X |

FOREIGN PATENT DOCUMENTS

| | | | |
|---|---|---|---|
| 192028 | 9/1957 | Austria | 401/115 |
| 2425062 | 12/1975 | Fed. Rep. of Germany | 401/115 |
| 1207758 | 2/1960 | France | 401/183 |

*Primary Examiner*—Steven A. Bratlie

*Attorney, Agent, or Firm*—Shoemaker and Mattare, Ltd.

[57] ABSTRACT

A fountain brush includes a reservoir serving as a handle. A one-piece valve body fixed in the neck of the reservoir contains a gravity-activated applicator brush holder which is shiftable within the valve body between liquid applying and non-applying positions. Valve elements on the opposite ends of the brush holder engage cooperative seats of the one-piece valve body in the liquid applying and non-applying positions of the brush holder.

1 Claim, 8 Drawing Figures

FOUNTAIN BRUSH

BACKGROUND OF THE INVENTION

The object of the present invention is to provide an improved gravity-assisted fountain brush for painting small objects, such as fingernails.

More particularly, the invention has for its object to provide a fountain brush having a minimum number of parts including essentially only one moving part, namely, a gravity controlled applicator brush unit which operates inside of a relatively stationary one-piece valve body to control the dispensing of a liquid to the applicator brush without dripping or overflow.

Certain known prior art fountain brushes exemplified by U.S. Pat. Nos. 877,822; 4,063,829, both issued to LaMura, and others, show gravity controlled fountain brushes in which a valve device separate from the movable brush unit regulates the flow of liquid to the applicator brush. The present invention essentially eliminates this separate control valve means and allows the weighted brush holder and the one-piece valve body within which the brush holder moves to form a satisfactory valve or regulator of the flow of liquid to the applicator brush. The elimination of the separate valve means materially reduces the cost of manufacturing the fountain brush without sacrificing its convenience and reliability of operation. The construction of the device in accordance with the invention is also more compact than known prior art devices and less susceptible to clogging or binding or other malfunctioning of moving parts.

Other features and advantages of the invention will become apparent to those skilled in the art during the course of the following detailed description.

DETAILED DESCRIPTION

Figure 4:
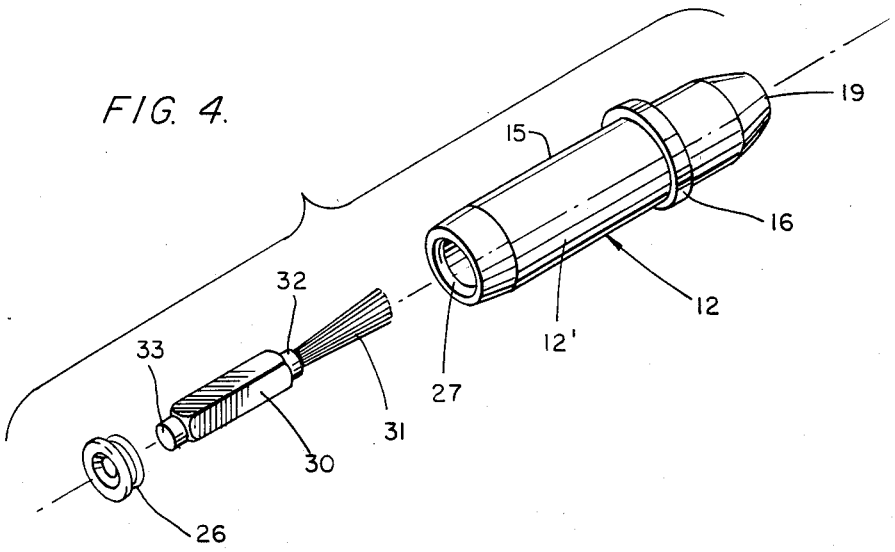
FIG. 4 is an exploded perspective view of a one-piece valve body and coacting applicator brush unit and plug.

Referring to the drawings in detail wherein like numerals designate like parts, a fountain brush in accordance with the present invention includes a liquid reservoir 10 serving as a handle, an internally threaded closure cap 11, and an applicator brush and control valve assembly 12 shown in an exploded state in FIG. 4.

The reservoir 10 at its leading end has a conically tapered wall section 13 terminating in a reduced diameter externally threaded neck 14. Within the bore of the neck 14 is snugly held an elongated cylindrical portion 15 of the one-piece valve body 12', the portion 15 extending somewhat beyond the tapered wall portion 13 and into the interior of the liquid reservoir 10. The one-piece valve body 12' has an external annular shoulder 16 which abuts the end face of the neck 14 to position the one-piece valve body in its proper assembled relationship with the reservoir 10.

At its forward or discharge end, the one-piece valve body 12' is provided with a short cylindrical outlet opening 17 leading into a conically flared bore or opening 18 terminating in a very short cylindrical outlet forming an annular resilient sealing lip 19 at the tip of the one-piece valve body 12'.

A cap seal 20 snugly held within the cap 11 has a splined end portion 21 frictionally held within a bore 22 of the cap 11 and an enlarged splined annular portion 23 similarly held within an enlarged bore of the cap 11 and engaging an interior annular shoulder 24 thereof. The cap seal 20 has a central conically tapered nose 25 adapted to enter and expand the resilient sealing lip 19 of the one-piece valve body 12' to form a secure liquid-tight seal therewith, FIG. 5.

The other end of one-piece valve body 12' receives a plug 26 which has snap locked engagement with an internal rib 27 of the valve body 12'. The plug 26 has a central conically tapered opening 28 formed therethrough with the smaller end of such opening being disposed toward the main interior bore 29 of the one-piece valve body 12'.

Figure 5:
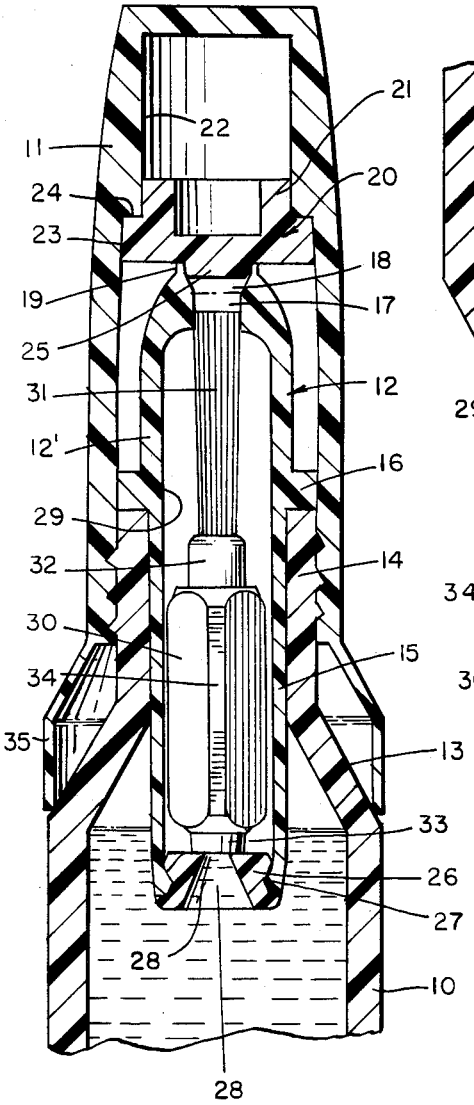
FIG. 5 is an enlarged fragmentary vertical section taken centrally through the fountain brush in a closed non-use position.

The valve assembly 12 further comprises in its main bore 29 an elongated weighted approximately square cross section brush holder 30 preferably formed of metal. At its leading end, the weighted brush holder 30 carries an applicator brush 31 whose bristles are suitably anchored to an extension 32 of the holder 30. At its opposite end, the brush holder 30 carries a center substantially cylindrical terminal 33 whose flat end face is adapted to abut the opposing end face of the plug 26 and cover the smaller end of the tapered opening 28 as shown in FIG. 5. When the brush holder 30 is positioned as in FIG. 5, the tips of the bristles forming the applicator brush 31 are received within the cylindrical opening 17 of the one-piece valve body 12'. At no time during the operation of the fountain brush do the brush bristles completely separate from the outlet opening 17.

As shown in the drawings, the weighted brush holder 30 also has narrow corner flats 34 which are spaced somewhat from the main bore 29 of valve body 12' to provide a relatively loose fit for the brush holder 30 in the bore 29. This loose fit precludes binding of the brush holder in the one-piece valve body during the use of the fountain brush.

Figure 1:
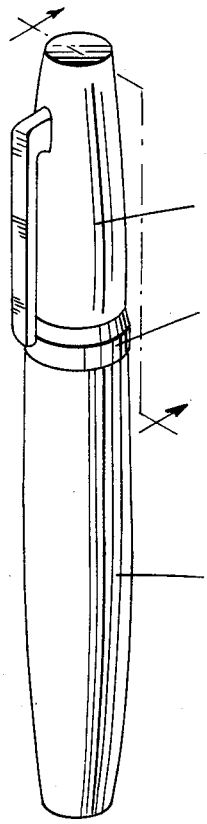
FIG. 1 is a perspective view of a fountain brush in accordance with the present invention.
Figure 2:
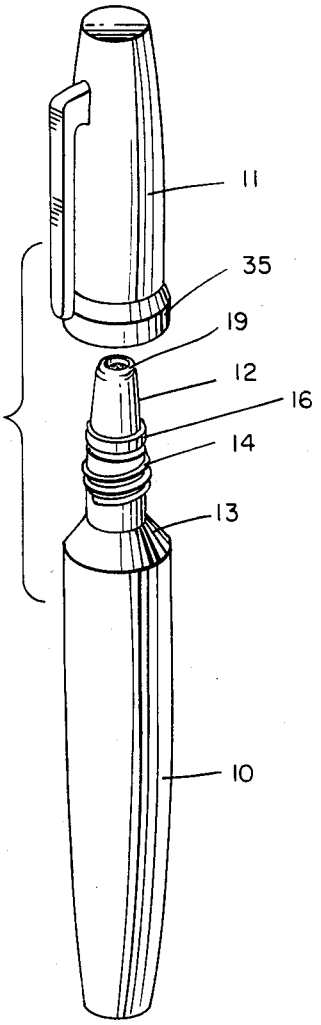
FIG. 2 is a partly exploded perspective view of the fountain brush.

The closure cap 11 is provided with a dust skirt 35 which engages the tapered wall portion 13 of the reservoir 10 when the cap is installed on the reservoir, as shown in FIGS. 1 and 5.

Operation

When the fountain brush is not being used, the cap 11 is securely tightened onto the neck 14 of the liquid reservoir 10 and the tapered nose 25 of the cap seal 20 engages in and expands the sealing lip 19 as shown in FIG. 5 so that no liquid from the reservoir can escape from the bore 29 even if the device is inverted from its position shown in FIG. 5 while the cap 11 is in place.

Figure 3:
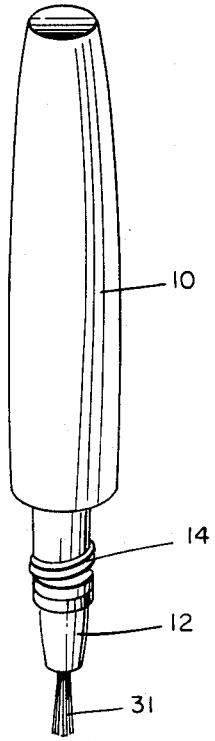
FIG. 3 is a perspective view of the fountain brush in its liquid applying position.
Figure 6:
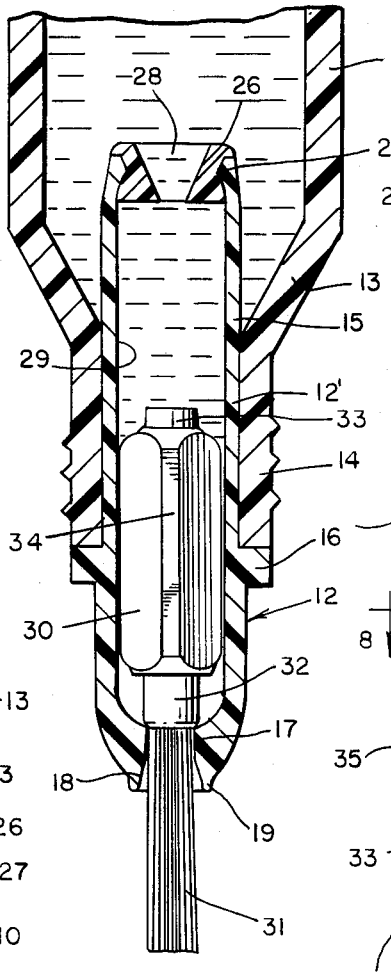
FIG. 6 is a similar view of the fountain brush in the inverted active use position with the closure cap removed.
Figure 8:
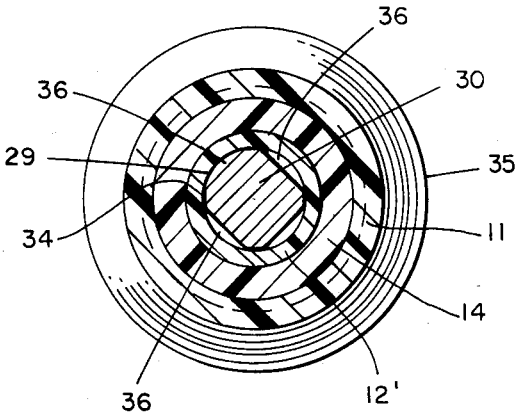
FIG. 8 is a horizontal section taken on line 8—8 of FIG. 7.

When it is desired to apply liquid, such as nail polish to fingernails, the cap 11 is loosened and removed from the reservoir and the fountain brush is inverted to the position shown in FIGS. 3 and 6. At this time, the brush holder 30 responding to the action of gravity descends in the bore 29 and the tapered opening 28 becomes uncovered and liquid from the reservoir 10 can fill the bore 29 behond the holder 30. The applicator brush 31 now projects through and beyond the cylindrical opening 17, as shown in FIG. 6. The extension 32 of holder 30 now rests in seated closing relationship with the inner end of outlet opening 17 to restrict the flow of liquid through this opening to the bristles of applicator brush 31. The liquid can flow toward the applicator brush through passages 36, FIG. 8, between the bore 29 and the flat faces of the square cross section holder 30. The weight of the holder 30 is sufficient to maintain the extension 32 seated at the inner end of the outlet opening 17, in effect forming an outlet valve for the fountain brush. During the painting of a fingernail or other small surface, the pressure transmitted through the brush bristles will be sufficient to cause some unseating of the extension 32 to allow controlled and restricted seepage of liquid through the opening 17 and into the brush bristles. However, there is no rapid flow of liquid to the applicator brush and therefore no excess of liquid and no dripping or overflow of liquid from the fountain brush during its use. In essence, the one-piece valve body 12' and the brush holder 30 function as a control valve for the liquid being dispensed to the applicator brush, without the necessity for a separate control valve device according to the prior art.

When the application of the liquid to a surface is completed, the fountain brush is simply returned to its position shown in FIGS. 1 and 5 and the cap 11 is applied to the neck 14. The tapered nose 25 again closes and seals the outlet opening 17 and the terminal 33 again closes the opening 28 while the fountain brush remains in an upright position. When the fountain brush assumes other positions, liquid can enter the bore 29 but cannot escape through the opening 17 while the cap 11 and its seal 20 are in place.

Figure 7:
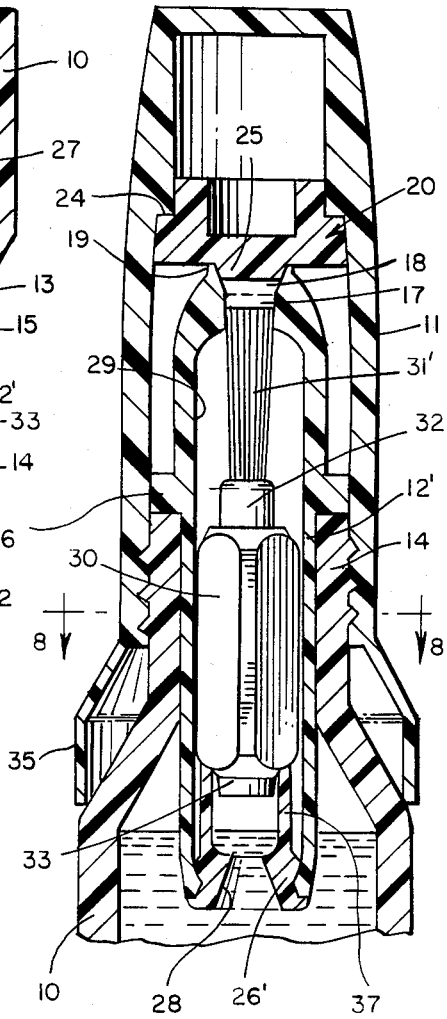
FIG. 7 is a view similar to FIG. 5 showing a variant of the invention.

FIG. 7 shows a slight variant of the invention allowing the use of a shorter applicator brush 31', such as a ⅜ inch brush compared to a ½ inch brush 31. The only difference in the construction of the device is that a plug 26' for the valve body 12' within the reservoir 10 includes a tubular extension 37 projecting somewhat into the bore 29 to support the brush holder 30 somewhat more distantly from the end of the valve body 12' which projects into the reservoir 10. This arrangement maintains the same spatial relationship of the brush 31' within the outlet opening 17, FIG. 7, which is maintained for the longer brush 31 in the opening 17, FIG. 5. All other components of the fountain brush shown in FIG. 7 are identical in construction and operation to the corresponding components shown in the prior embodiment of the invention and there is no necessity for repeating the description of the mode of operation of the fountain brush.

It can be seen that a more simplified and less expensive fountain brush is provided according to the invention in which the weighted brush holder 30 serves a dual function which eliminates the necessity for a separate ball control valve or another form of separate control valve. The weighted holder 30 responds to gravity by moving the brush 31 to and from its extended and retracted positions while simultaneously coacting with the one-piece valve body 12' in the manner previously described to control and restrict the outflow of liquid from the reservoir 10 to the bristles of brush 31. Thus, the holder 30 serves simultaneously as the applicator brush positioner and as a liquid outflow control valve element.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A fountain brush comprising a liquid reservoir member serving as a handle for the brush and having a threaded neck, a valve body extending through the neck and into the interior of the liquid reservoir member and also extending outwardly from the neck, a shoulder element on the valve body abutting the end face of the neck to position the valve body on the reservoir member, the inner end of the valve body having a constricted opening, a plug having snap-locked engagement in the restricted opening and having an interior flat end face defining a valve seat and having a central outwardly flared opening forming the inlet of the valve body for liquid contained in the reservoir member, the other end of the valve body having a central cylindrical liquid outlet opening including an outer conically flared portion surrounded by a thin annular lip which defines the outer end of the valve body, the cylindrical outlet opening at its inner end defining a second valve seat on the valve body, a polygonal cross-section gravity-operated applicator brush holder movably held in the interior of the valve body between said valve seats and being captively held therein, a pair of valve elements on opposite ends of the applicator brush holder and each being adapted to engage one of said valve seats in one shifted position of the brush holder within the valve body, said valve elements closing said liquid inlet and outlet openings when engaging said seats, an applicator brush fixed to one valve element of the brush holder and extending axially therefrom and being engaged within the liquid outlet opening of the valve body in all positions of the applicator brush holder, a closure cap for the reservoir member having threaded engagement with said neck and including an interior seal fixed therein between the ends of the closure cap, and said seal including a central tapered projection coaxially aligned with the liquid outlet opening and said thin annular lip and being adapted to engage snugly and sealingly within said lip when the closure cap is fully applied to the neck of the reservoir member.

* * * * *